US011566443B2

(12) United States Patent
Golgiri et al.

(10) Patent No.: US 11,566,443 B2
(45) Date of Patent: Jan. 31, 2023

(54) FOLDING BACKUP KEY

(71) Applicant: FORD GLOBAL TECHNOLOGIES, LLC, Dearborn, MI (US)

(72) Inventors: Hamid M. Golgiri, Livonia, MI (US); Aaron Matthew DeLong, Toledo, OH (US); Anthony Melatti, Dearborn, MI (US); Patrick Lawrence Jackson Van Hoecke, Livonia, MI (US); Danielle Rosenblatt, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 682 days.

(21) Appl. No.: 16/570,225

(22) Filed: Sep. 13, 2019

(65) Prior Publication Data

US 2021/0079687 A1 Mar. 18, 2021

(51) Int. Cl.
*E05B 19/18* (2006.01)
*E05D 3/02* (2006.01)

(52) U.S. Cl.
CPC ..... *E05B 19/18* (2013.01); *E05D 3/02* (2013.01)

(58) Field of Classification Search
CPC ..... E05B 19/18; E05D 3/02; Y10T 70/7802
See application file for complete search history.

(56) References Cited

U.S. PATENT DOCUMENTS 1,662,613 A * 3/1928 Laynor ..... E05B 19/18 70/398
1,899,739 A * 2/1933 Von Mehren ..... E05B 19/18 70/411
1,979,798 A * 11/1934 Glidden ..... E05B 19/00 70/400
4,099,398 A * 7/1978 Lipschutz ..... E05B 19/00 70/408
4,429,554 A * 2/1984 Litvin ..... E05B 19/0035 70/358
4,951,489 A * 8/1990 Proch ..... A45C 11/323 70/456 R
5,022,247 A * 6/1991 Beck ..... A45C 11/326 70/456 R (Continued)

FOREIGN PATENT DOCUMENTS

WO 2007065723 A1 6/2007

OTHER PUBLICATIONS

Renault Captur's Smart Access Card—What is it?, Daily Post e-Paper, Nov. 1, 2017, retrieved from http://dailypost.in/news/automobiles/renault-capturs-smart-access-card/ on Apr. 30, 2019.

*Primary Examiner* — Victor D Batson
*Assistant Examiner* — Matthew J Sullivan
(74) *Attorney, Agent, or Firm* — Frank L. Lollo; Brooks Kushman P.C.

(57) ABSTRACT

A foldable card includes first and second sections, each defining a base and a layer of a blade of a key extending therefrom; and a hinge interface connecting the bases of the first and second sections, wherein the first section is configured to fold over the second section at the hinge interface so that a top surface of the first section is against a bottom surface of the second section and each of the layers of the blades align to form the blade of the key, and the first and second sections are configured to fold at the hinge interface into a storage position to form a collective flat surface.

18 Claims, 11 Drawing Sheets

(56) References Cited

U.S. PATENT DOCUMENTS

| | | | | |
|---|---|---|---|---|
| 5,113,602 | A * | 5/1992 | Levine | G09F 3/08 40/330 |
| 5,355,702 | A * | 10/1994 | Escribens | E05B 19/18 70/411 |
| 6,755,061 | B2 * | 6/2004 | Herzenberg | E05B 19/04 70/459 |
| 6,824,066 | B2 * | 11/2004 | Weyant | G06K 19/041 235/487 |
| 7,690,233 | B2 | 4/2010 | Katagiri et al. | |
| 7,956,741 | B2 | 6/2011 | Tamezane et al. | |
| 8,006,832 | B2 * | 8/2011 | Ateca | E05B 19/18 206/38.1 |
| 8,798,809 | B2 | 8/2014 | Kalhous et al. | |
| 9,460,571 | B2 | 10/2016 | Kleve et al. | |
| 9,696,691 | B2 | 7/2017 | Menard et al. | |
| 10,137,861 | B2 | 11/2018 | Park et al. | |
| 11,027,699 | B2 * | 6/2021 | Golgiri | B60R 25/22 |
| 2003/0222755 | A1 | 12/2003 | Kemper et al. | |
| 2007/0006622 | A1 | 1/2007 | Luo | |
| 2007/0214851 | A1 | 9/2007 | Yamaguchi et al. | |
| 2013/0154794 | A1 | 6/2013 | Menard et al. | |
| 2014/0375423 | A1 | 12/2014 | Lagabe | |
| 2016/0110938 | A1 | 4/2016 | Kleve et al. | |
| 2017/0234034 | A1 | 8/2017 | Borenstein | |
| 2017/0268255 | A1 | 9/2017 | Zhang et al. | |
| 2017/0338848 | A1 | 11/2017 | Sharma et al. | |
| 2019/0122464 | A1 | 4/2019 | DeLong et al. | |
| 2020/0353604 | A1 * | 11/2020 | Gallegos | B25B 15/008 |

* cited by examiner

FOLDING BACKUP KEY

TECHNICAL FIELD

Aspects of the disclosure generally relate to a folding backup key, which may be used as a backup for access to vehicles.

BACKGROUND

When a battery of a locked vehicle falls below a certain state of charge, the user of the vehicle may use a mechanical key to unlock and open the door, and then pull the hood release. Opening the hood is a step to getting the vehicle mobile again, since this may be the only way to jump-start the vehicle or replace the battery.

For vehicles with Passive-Entry/Passive-Start (PEPS) fobs, the user does not use a mechanical key under normal operation. However, within the key fob is a mechanical backup key, in case of a failure of the PEPS system (dead fob battery, dead car battery, etc.).

Some vehicles are now equipped with a Phone-as-a-Key (PaaK) feature, where the vehicle is normally unlocked or locked via the user's smartphone. The vehicle may be sold with a PEPS fob containing the standard mechanical backup key, but a typical PaaK user may not carry the PEPS fob due to its general large size, or the backup key due to its thickness or their unawareness that the backup key is contained within the fob. This means that, in the event of a locked vehicle with a poor battery, there may be no direct means of opening the hood (e.g., to jump-start the vehicle or replace the battery).

In this scenario, the user may be forced to call a locksmith or roadside assistance (assuming lock-picking and jump-starting capabilities), or a roommate or other person who is able to retrieve the PEPS fob containing the mechanical backup key. While awaiting assistance, the user may be in an undesirable outside environment, such as in the cold or rain, or on a busy roadway.

SUMMARY

In a first illustrative example, a foldable keycard includes first and second sections, each defining a base and a layer of a blade of a key extending therefrom; and a hinge interface connecting the bases of the first and second sections, wherein the first section is configured to fold over the second section at the hinge interface so that a top surface of the first section is against a bottom surface of the second section and each of the layers of the blades align to form the blade of the key, and the first and second sections are configured to fold at the hinge interface into a storage position to form a collective flat surface.

In a second illustrative example, a foldable keycard includes first and second sections, each defining a section opening, a base, and a layer of a blade of a key extending from the base, wherein in an extended state, the openings symmetrically align and open to one another to form an interface opening; and an insert arranged within the interface opening and connected to each of the first and second sections within the respective section opening at first and second respective hinges, wherein the insert is configured to create a hinge interface between the sections so that a top surface of the first section is folded to rest against a bottom surface of the second section and the layers of the blades align to form the blade of the key.

In a third illustrative example, a foldable keycard includes first, second, and third sections, each defining a base and a layer of a blade of a key extending therefrom; a first hinge interface connecting the bases of the first and second sections; and a second hinge interface connecting the bases of the second and third sections, wherein the first section is configured to fold over the second section at the first hinge interface so that a top surface of the first section is against a bottom surface of the second section, and the second section is configured to fold over the third section at the second hinge interface so that a top surface of the second section is against a bottom surface of the third section, and each of the layers of the blades align to form the blade of the key.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Plastic break-away wallet keycards may be manufactured as a thick card with a mostly-cutaway key that can be broken out and used. However, such keycards may be too thick to comfortably be placed in a wallet. For example, such keys may be on the order of two to three millimeters thick, compared to the ISO standard thickness for credit cards of 0.76 millimeters. Additionally, once the user breaks the spare key away from the card carrier, the key is now loose and lacks an easy way to be stored. In effect, before the first use the keycard is convenient to store but after the first use the break-away key is no more convenient that a regular metal non-RFID blade with the proper cut. Metal backup keys are also about 3 millimeters thick (the same thickness as a normal key). This is also generally too thick for wallet storage.

It may be desirable to offer a credit-card-sized backup key that is small enough to not be considered a nuisance to carry in a wallet. For example, such a key may be useful to have as a backup for Phone-as-a-Key keyless entry systems. A difficulty in creating a usable mechanical key in the size of a credit card in that the mechanical key needs to be thicker than a credit card. This may be addressed by allowing the card to fold into the shape of a full-thickness mechanical key.

Figure 1:
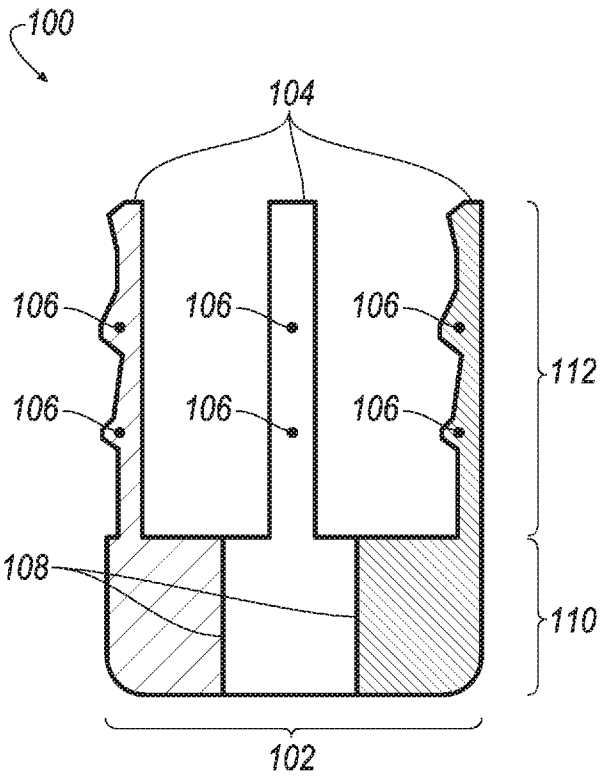
FIG. 1 illustrates an example of a foldable keycard in a storage state.

FIG. 1 illustrates an example 100 of a foldable keycard 102 in a storage state. As shown, the keycard 102 includes mechanical key sections 104, connection points 106, and hinges 108. Each of the sections 104 includes a base 110 and a layer of a blade 112 of the key. The backup foldable keycard 102 may be configured to fold along the hinges 108 to cause the layers of the blade 112 to align to form the key. The keycard 102 may also be unfolded along the hinges 108 and stored flat and thin as a collective flat surface. Such a keycard 102 may be created to be about the size of a credit card. For a wave cut key, two hinges 108 for three sections 104 of the key may be used. Other types of keys, such as sawblade keys, may be created with only a single hinge 108 and two sections 104.

To aid in maintaining alignment of the mechanical key sections 104, the connection points 106 along the sides of the sections 104 may be provided. In one example, on one section a protrusion may be provided, which may fit into a corresponding recess on the next section. In another example, small magnets may be provided as connection points 106, placed within or on top of the sections 104 of the card to secure the sections 104 together in the folded state. The connections points 106 may be placed along the length of the mechanical key, at the base 110 (e.g., the handle region) or both.

The amount of torque needed to open a lock cylinder is on the order of one half to two Newton-meters (Nm). As the sections of the keycard 102 may be folded before use, the keycard 102 may be manufactured in a thickness and/or in a material that may be unusable to open the lock in a single section 104, but may be of acceptable strength once folded. In one example, the backup keycard 102 may be composed of metal. In another example, the backup keycard 102 may be composed of plastic. It should be also noted that different pieces of the keycard 102 may be composed of different materials. For instance, the blade 112 portions may be metal, while the hinge 108 portions and foldaway electronics area 302 (discussed below) may be made of plastic.

Figure 2:
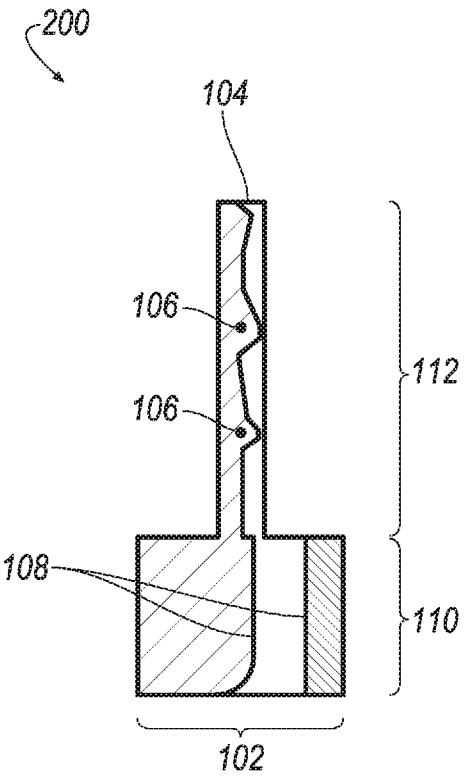
FIG. 2 illustrates an example of a foldable keycard in a folded usage state.

FIG. 2 illustrates an example 200 of a foldable keycard 102 in a folded usage state. As shown, the three mechanical key sections 104 have been folded together along the hinge 108, aligned by the connection points 106, such that the layers of the blade 112 combine to form the complete blade of the key.

Figure 3:
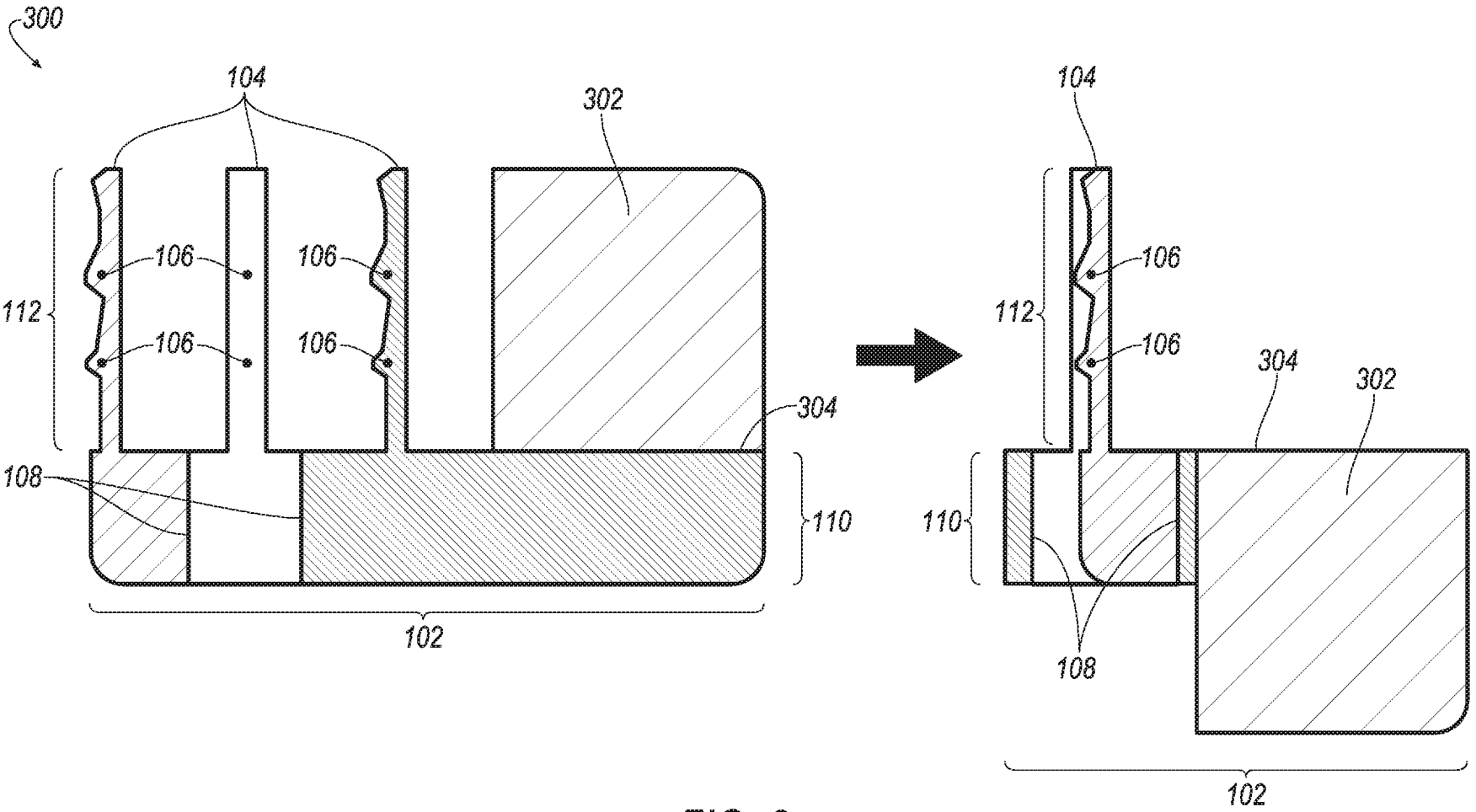
FIG. 3 illustrates an example of a foldable keycard in a longitudinal orientation.

FIG. 3 illustrates an example 300 of a foldable keycard 102 in a longitudinal orientation. Using the longitudinal side may be advantageous in keys with a blade 112 length less than the card width. This also provides an electronics area 302 on the keycard 102 that extends from the base 110 of one of the sections 104 and that could be used to place other components, such as passive or active wireless electronics. This electronics area 302 may be configured to be folded back from the blades 112 with an additional hinge 304. This may allow the electronics area 302 to fold out of the way to allow the complete blade 112 of the keycard 102 to be inserted into a lock cylinder.

Figure 4:
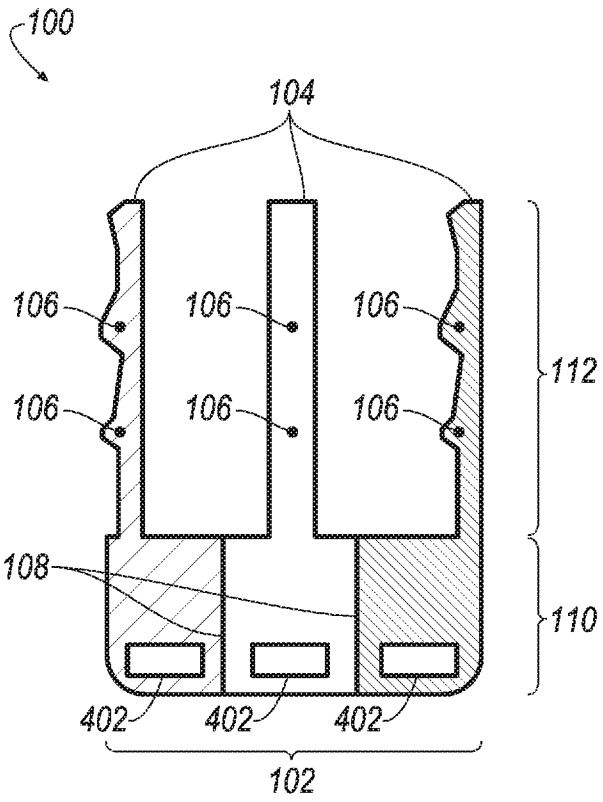
FIG. 4 illustrates an example of a variation of a foldable keycard having openings in the handle portion.

FIG. 4 illustrates an example 400 of a variation of a foldable keycard 102 having openings 402 in the base 110 portion. For instance, each section 104 of the base 110 may have an opening 402 at a location such that the openings 402 overlap when the sections 104 are folded together to form the complete blade 112. These openings 402 on the base 110 portions may be useful if the keycard 102 is kept in a folded state on a key ring.

Figure 5:
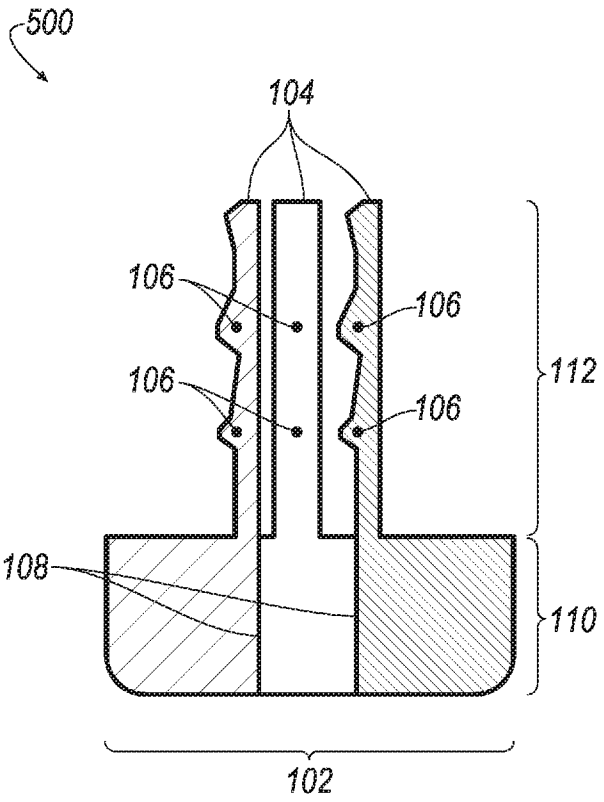
FIG. 5 illustrates an example variation of a foldable keycard having foldable sections closer to the hinges of the key.

FIG. 5 illustrates an example 500 variation of a foldable keycard 102 having the foldable sections 104 closer to the hinges 108 of the keycard 102. As can be seen, the blades 112 of the foldable sections 104 may be closer to the hinges 108 or further from the hinges 108 but may still provide for the same ultimate blade 112 shape once folded along the hinges 108.

Figure 6:
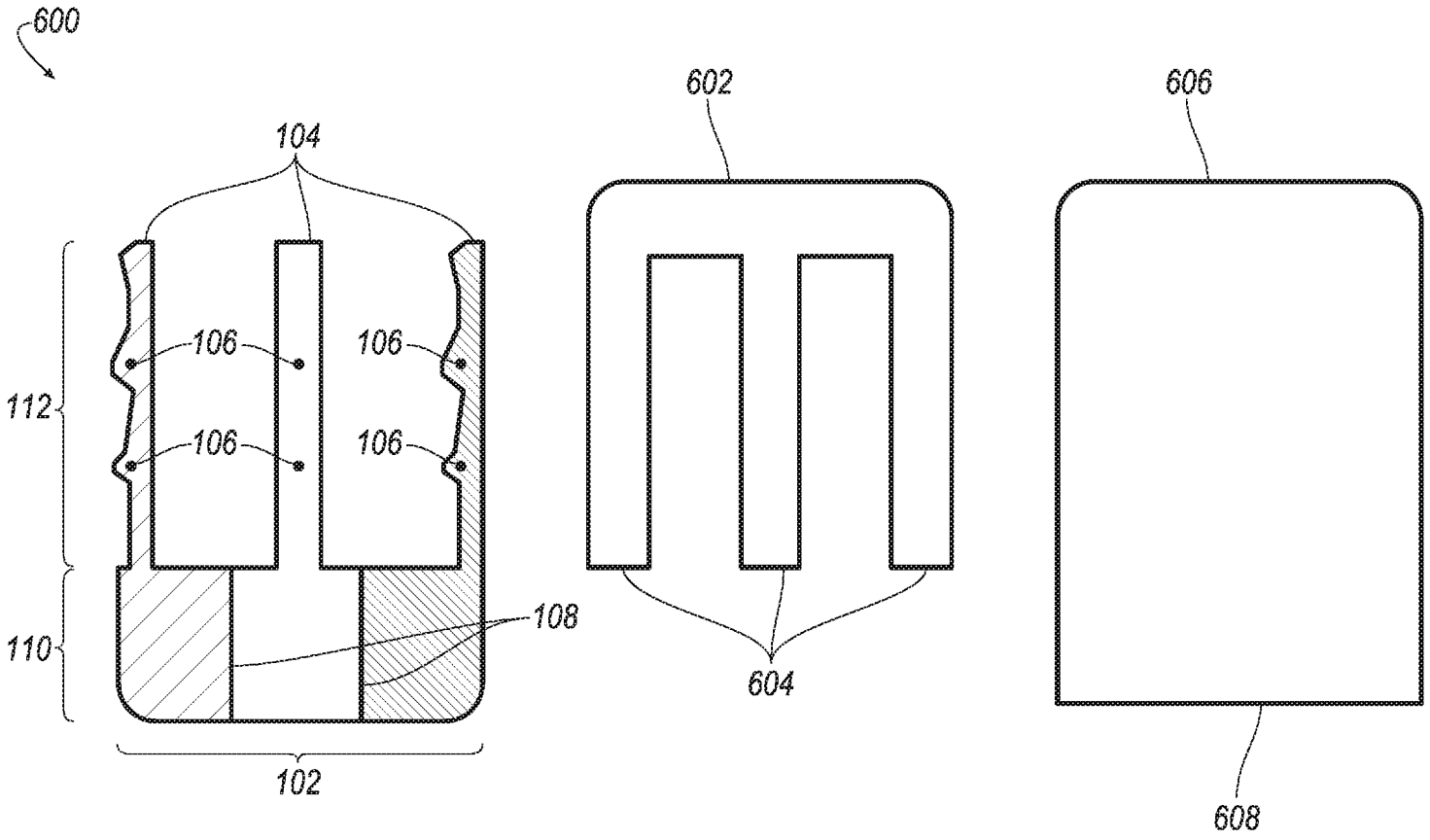
FIG. 6 illustrates an example of sleeves that may be used to hold the foldable keycard.

FIG. 6 illustrates an example 600 of sleeves 602, 606 that may be used to hold the foldable keycard 102. As shown, the sleeves 602, 606 may be a protective open-ended flat or tubular packaging or cover in which the blades 112 of the foldable keycard 102 may be inserted to prevent the foldable keycard 102 from folding. The sleeve 602 includes a plurality of openings 604, each for holding one of the blades 112 of the foldable keycard 102. The sleeve 606, however, includes only a single opening 608 into which the entire foldable keycard 102 may be inserted.

Figure 7:
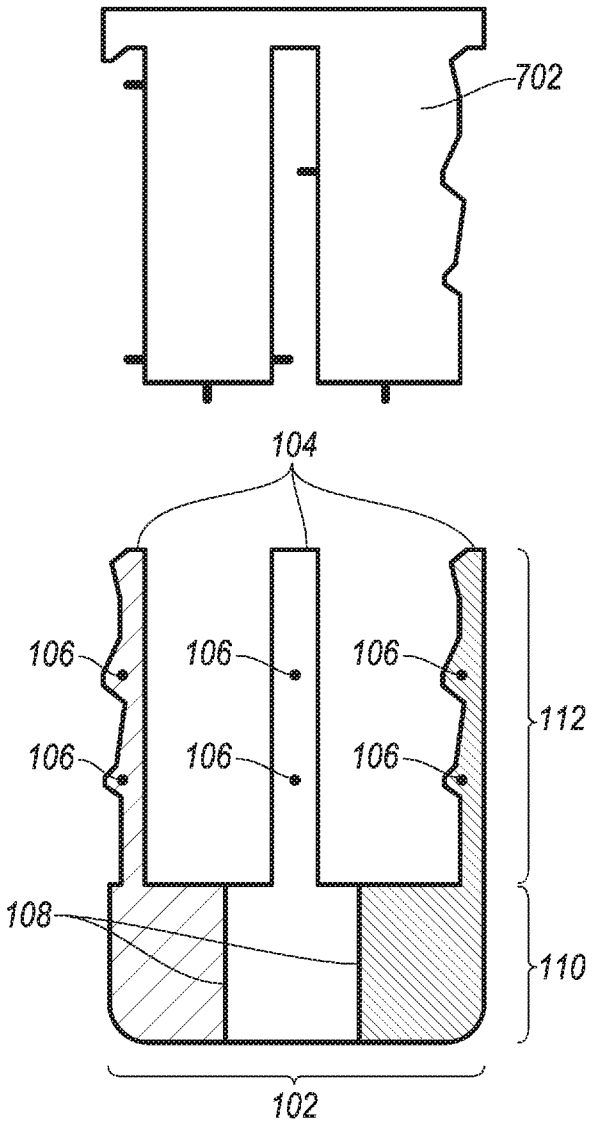
FIG. 7 illustrates an example of a removable insert that may be used to hold the foldable keycard.
Figure 7:
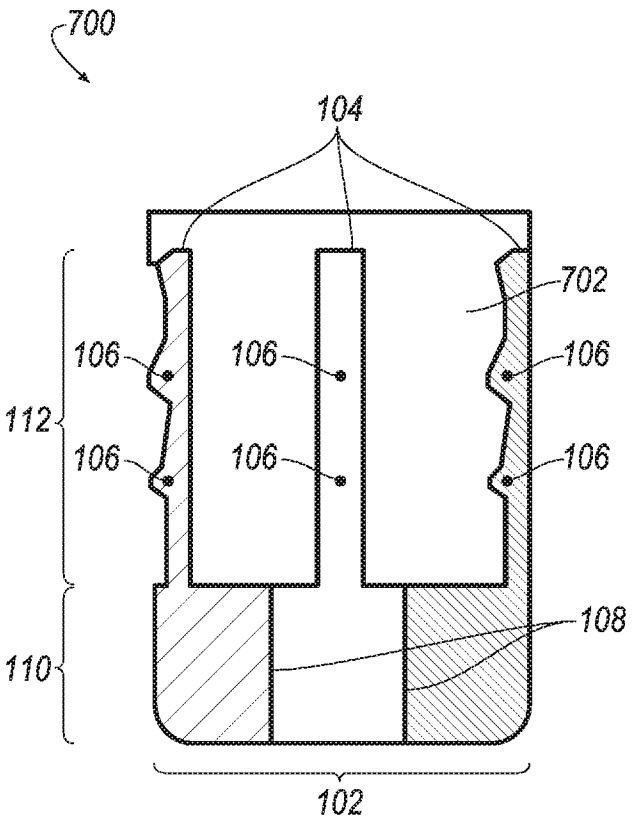

FIG. 7 illustrates an example 700 of an insert 702 that may be used to hold the foldable keycard 102. As shown, the removable insert 702 may fit within the region defined by the blades 112 of the foldable sections 104 of the keycard 102 and may therefore serve to protect the blades 112 and keep the foldable keycard 102 in a flat position. In an example, the removable insert 702 may be formed of plastic to allow it to flex somewhat in order to be inserted or removed from the blades 112 of the foldable keycard 102.

Figure 8:
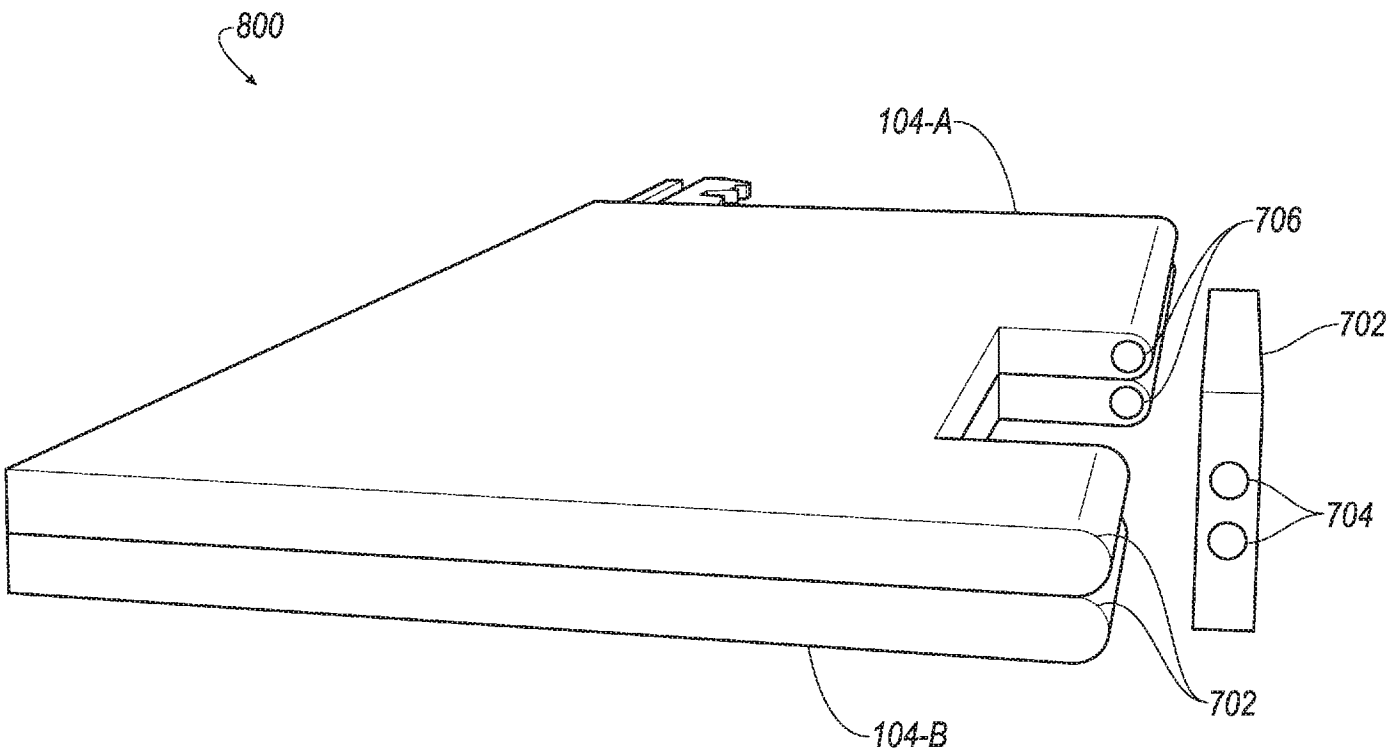
FIG. 8 illustrates an example detail of a hinge that may be used for the foldable keycard.

FIG. 8 illustrates an example 800 detail of a hinge 108 that may be used for the foldable keycard 102. As shown, the hinge 108 interface at a first foldable section 104-A and a second foldable section 104-B includes an insert 702 that connects a hinge of the first foldable section 104-A to a hinge of the second foldable section 104. This insert 702 allows for a flush, clean fold, without material flexing of the first foldable section 104-A or the second foldable section 104-B. The edges of the first foldable section 104-A and a second foldable section 104-B may be rounded to aid in proper clearance for the folding of the sections 104.

The insert 702 may be connected to the foldable sections 104 using a nub and recess design. In one example, the insert 702 may include nubs 704 that interface with corresponding recesses 706 in the sections 104. In another example, the insert 702 may include recesses 704 that interface with corresponding nubs 706 in the sections 104.

Figure 9:
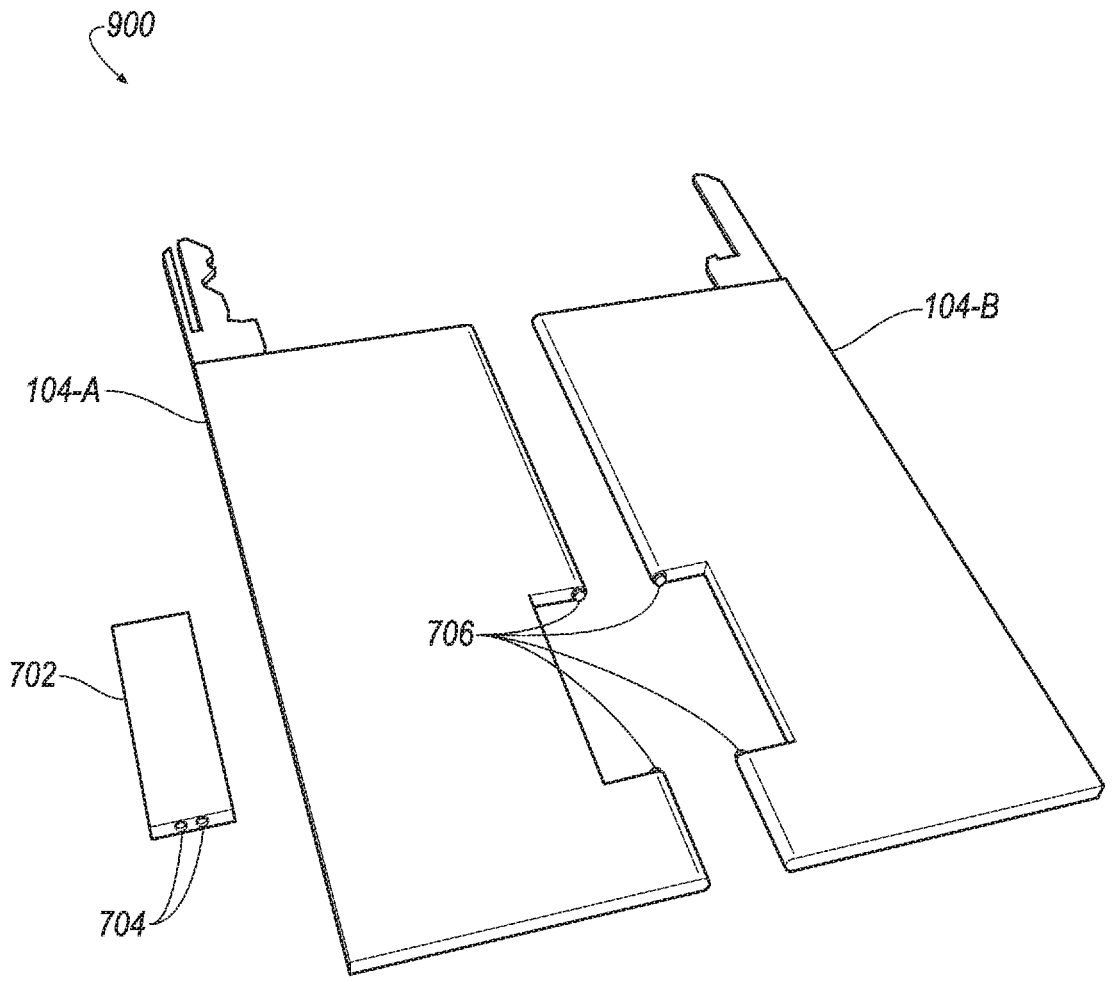
FIG. 9 illustrates an example view of a foldable keycard including a hinge having an insert.

FIG. 9 illustrates an example 900 of an alternate view of a foldable keycard 102 including a hinge 108 having an insert 702. Similar to as shown in the example 800, the hinge 108 interface of a first foldable section 104-A and a second foldable section 104-B includes an insert 702 that fastens between the first foldable section 104-A and the second foldable section 104=B, where the insert 702 includes recesses 706 that interface with corresponding nubs 704 on the sections 104 to form the hinge 108. Specifically, a first hinge formed with the first foldable section 104-A includes first pivot nubs that are sized to mate with and pivot within first pivot recesses, and a second hinge formed with the second foldable section 104-B includes second pivot nubs that are sized to mate with and pivot within second pivot recesses.

Figure 10:
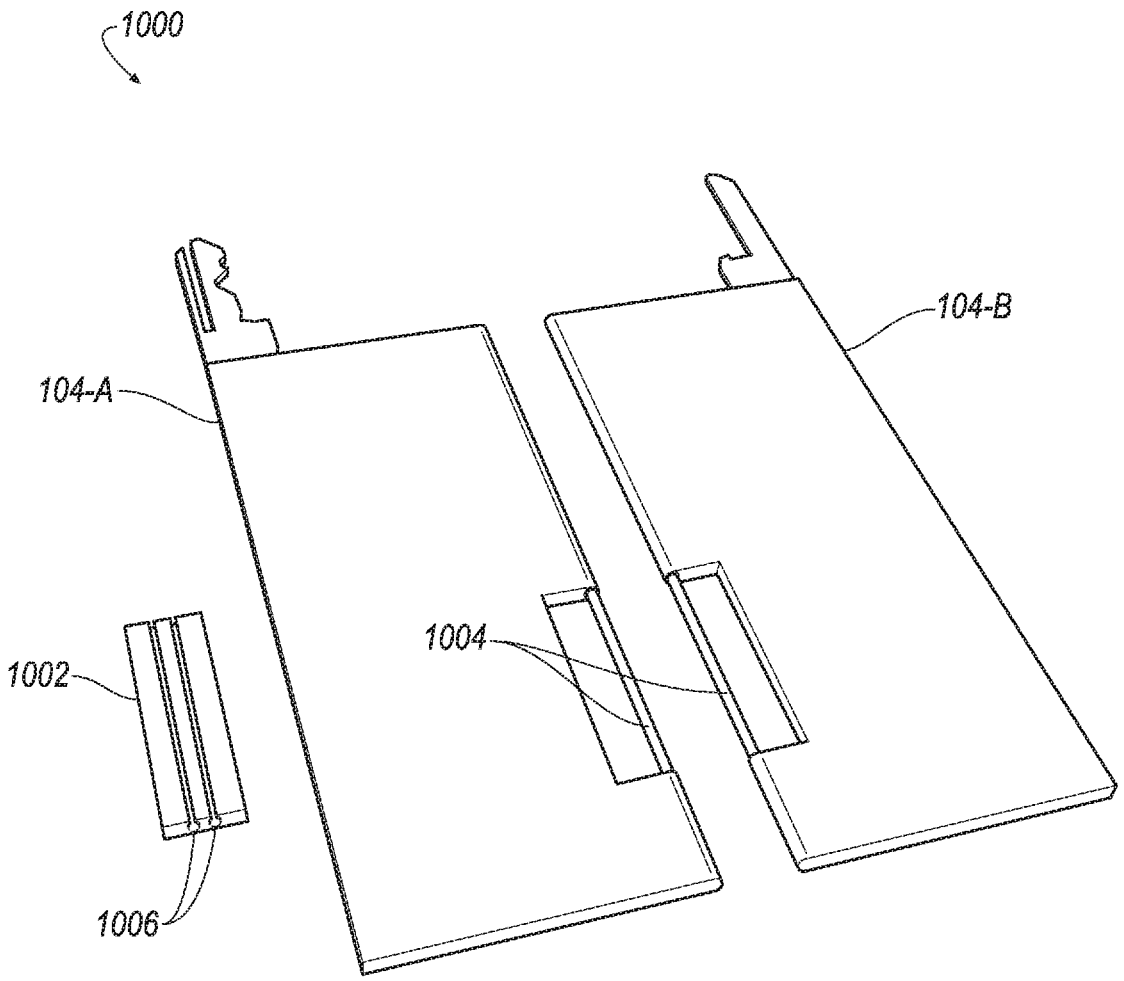
FIG. 10 illustrates an example of an alternate mechanism for a foldable keycard including a hinge having an insert.

FIG. 10 illustrates an example 1000 of an alternate mechanism for a foldable keycard 102 including a hinge 108 interface having an insert 1002. In the alternate mechanism, the hinge 108 interface between a first foldable section 104-A and a second foldable section 104-B includes the insert 1002, which has channels 1004 that snap onto pins 1006 of the foldable sections 104.

Figure 11:
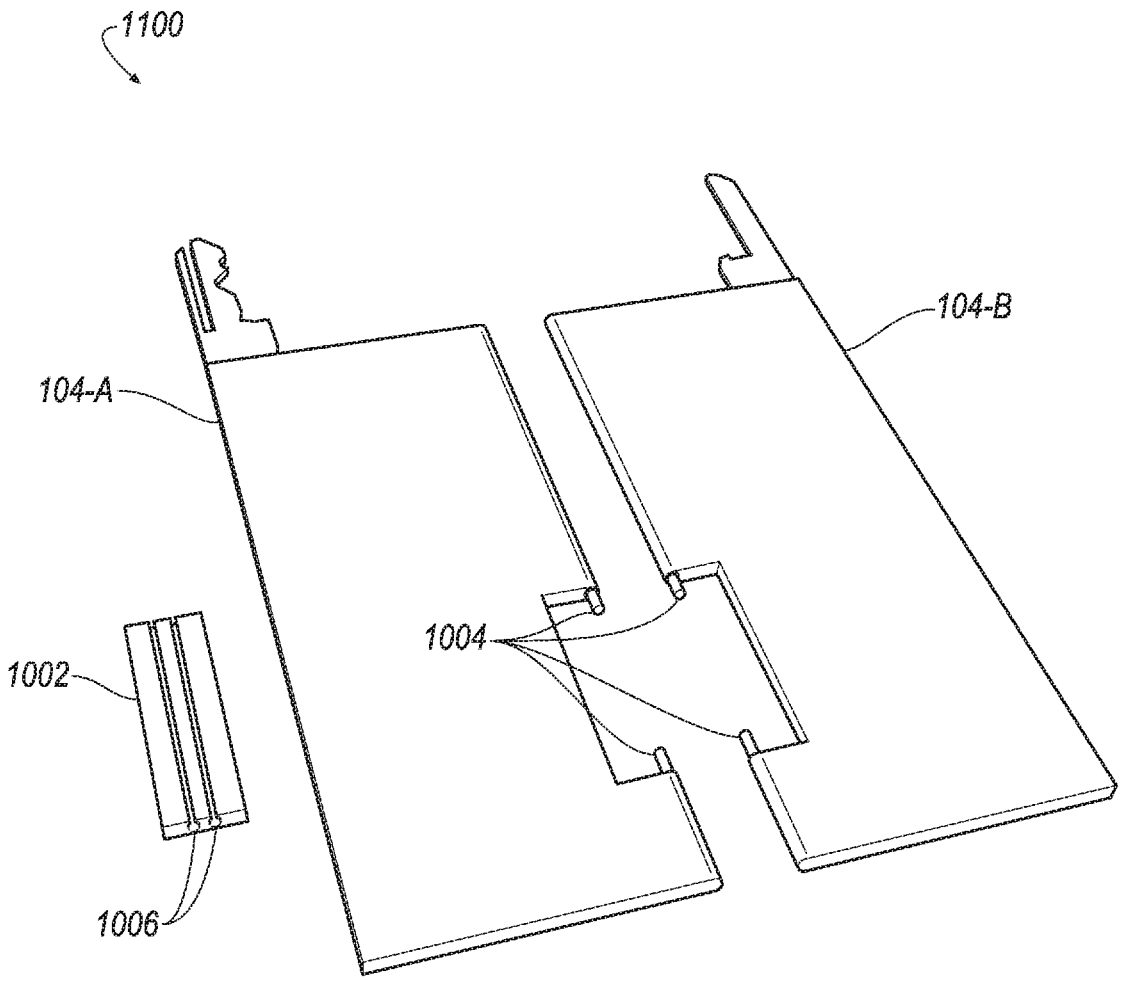
FIG. 11 illustrates example of another alternate mechanism for a foldable keycard including a hinge having an insert.

FIG. 11 illustrates an example 1100 of another alternate mechanism for a foldable keycard 102 including a hinge 108 interface having an insert 1102. In this alternate mechanism, the hinge 108 interface between a first foldable section 104-A and a second foldable section 104-B includes the insert 1102 which has cutaway channels that snap onto partial pins 1106 of the foldable sections 104.

Figure 12:
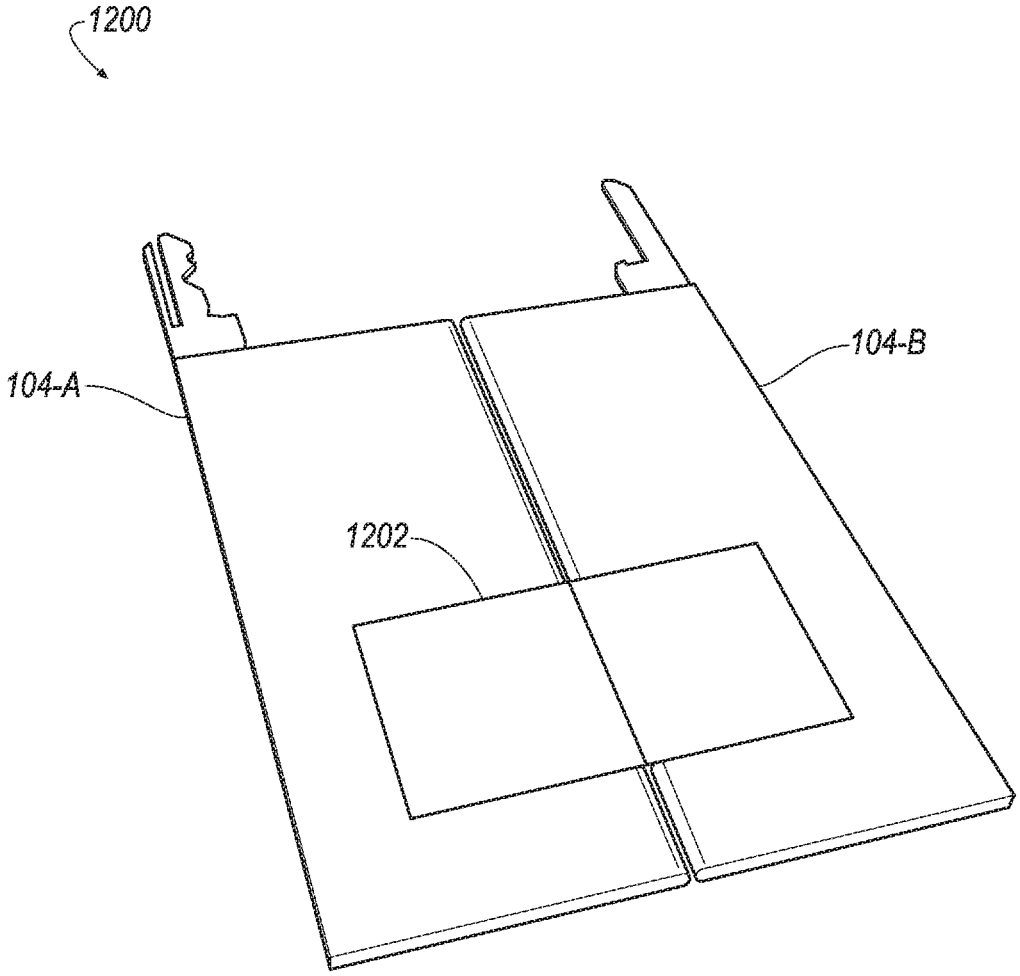
FIG. 12 illustrates an example of yet a further type of hinge for a foldable keycard.

FIG. 12 illustrates an example 1200 of yet a further type of hinge 108 for a foldable keycard 102. As shown the hinge 108 may include a thin, ribbon-like, flexible material 1202 applied to surfaces of first foldable section 104-A and a second foldable section 104-B, wherein the flexible material 1202 may bend to allow for folding along a center line between the foldable sections 104. In one example, the flexible material 1202 may include a piece of tape across the two bases 110 of the foldable sections 104. The flexible material 1202 may both keep the two foldable sections 104 together (so that they do not become separated or lost) and may also allow for easy folding when desired.

Figure 13B:
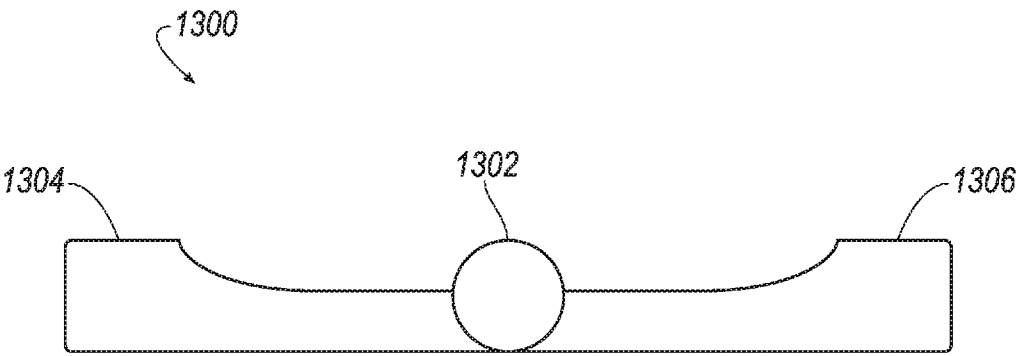
FIGS. 13A, 13B, and 13C each illustrate example details of a pin hinge that may be used as a hinge in a foldable keycard.
Figure 13C:
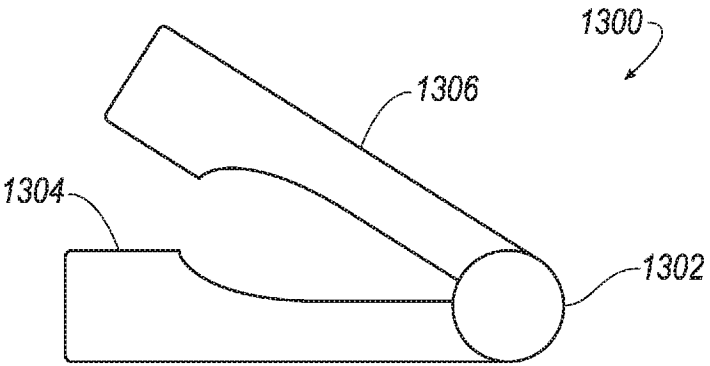
Figure 13A:
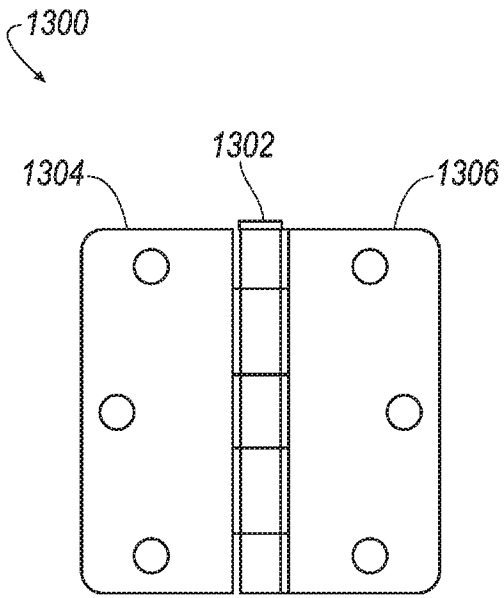

FIG. 13 illustrates an example 1300 of a detail of a pin hinge that may be used as a hinge 108 in a foldable keycard 102. The hinge includes a rod 1302 that holds the leaves 1304 and 1306 together inside of a knuckle, which is a hollow, typically circular portion creating the joint of the hinge through which the pin is set. The knuckles of either leaf 1304, 1306 typically alternate and interlock with the pin passing through all of them. As shown at B, a cutaway space allows the two leaves 1304 and 1306 to fold together. There may be some amount of flexing occurring when the keycard 102 is folded, since the edges may be full thickness, depending on the design of the leaves 1304, 1306.

Thus, a user may carry a foldable keycard 102 that folds flat and thin for ease of carrying, but that folds into shape for increased thickness. Such a keycard 102 may be useful in situations in which a vehicle battery is unable to electronically unlock or otherwise power the vehicle.

It is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A foldable keycard, comprising:

first and second sections, each defining a base and a layer of a blade of a key extending therefrom; and a hinge interface connecting the bases of the first and second sections, wherein the first section is configured to fold over the second section at the hinge interface so that a top surface of the first section is against a bottom surface of the second section and each of the layers of the blades align to form the blade of the key, and the first and second sections are configured to fold at the hinge interface into a storage position to form a collective flat surface, wherein the hinge interface includes a first hinge at an edge of the first section, a second hinge at an edge of the second section, and an insert configured to connect the first hinge to the second hinge.

2. The foldable keycard of claim 1, wherein the hinge interface includes a flexible material attached to the top surface of the first section and the top surface of the second section.

3. The foldable keycard of claim 1, wherein edges of the first section and the second section at the hinge interface are rounded to provide clearance for folding the sections.

4. The foldable keycard of claim 1, wherein the first section includes one or more protrusions configured to fit into corresponding recesses on the second section to align the layers of the blade.

5. The foldable keycard of claim 1, wherein the first hinge includes first pivot nubs of the first section that are sized to mate with and pivot within first pivot recesses of the insert, and the second hinge includes second pivot nubs of the second section that are sized to mate with and pivot within second pivot recesses of the insert.

6. The foldable keycard of claim 1, wherein the first hinge includes first pivot nubs of the insert that are sized to mate with and pivot within first pivot recesses of the first section, and the second hinge includes second pivot nubs of the insert that are sized to mate with and pivot within second pivot recesses of the second section.

7. The foldable keycard of claim 1, wherein the first hinge includes a first pin extending along an edge of the first section, the second hinge includes a second pin extending along an edge of the second section, and the insert defines a first channel to receive the first pin to allow rotation of the insert about the first pin and a second channel to receive the second pin to allow rotation of the insert about the second pin.

8. The foldable keycard of claim 7, wherein the first pin and the second pin extend through a portion of the channels.

9. The foldable keycard of claim 1, further comprising key electronics arranged at the base of the sections opposite the blades, and configured to fold away from the blades to allow the keycard to be inserted into a lock.

10. The foldable keycard of claim 1, further comprising a sleeve including a first opening for receiving a first layer of the blade and a second opening for receiving a second layer of the blade.

11. A foldable keycard, comprising:

first and second sections, each defining a section opening, a base, and a layer of a blade of a key extending from the base, wherein in an extended state, the openings symmetrically align and open to one another to form an interface opening; and an insert arranged within the interface opening and connected to each of the first and second sections within the respective section opening at first and second respective hinges, wherein the insert is configured to create a hinge interface between the sections so that a top surface of the first section is folded to rest against a bottom surface of the second section and the layers of the blades align to form the blade of the key.

12. The foldable keycard of claim 11, wherein the first hinge includes first pivot nubs of the first section that are sized to mate with and pivot within first pivot recesses of the insert, and the second hinge includes second pivot nubs of the second section that are sized to mate with and pivot within second pivot recesses of the insert.

13. The foldable keycard of claim 11, wherein the first hinge includes first pivot nubs of the insert that are sized to mate with and pivot within first pivot recesses of the first section, and the second hinge includes second pivot nubs of the insert that are sized to mate with and pivot within second pivot recesses of the second section.

14. The foldable keycard of claim 11, wherein the first hinge includes a first pin extending along an edge of the first section, the second hinge includes a second pin extending along an edge of the second section, and the insert includes a first channel to snap onto the first pin to allow rotation of the insert about the first pin and a second channel to snap onto the second pin to allow rotation of the insert about the second pin.

15. The foldable keycard of claim 11, wherein the insert is composed of plastic, and the layers of the blade of the key are composed of metal.

16. A foldable keycard, comprising:

first, second, and third sections, each defining a base and a layer of a blade of a key extending therefrom;

a first hinge interface connecting the bases of the first and second sections; and a second hinge interface connecting the bases of the second and third sections, wherein the first section is configured to fold over the second section at the first hinge interface so that a top surface of the first section is against a bottom surface of the second section, and the second section is configured to fold over the third section at the second hinge interface so that a top surface of the second section is against a bottom surface of the third section, and each of the layers of the blades align to form the blade of the key, and wherein the first hinge interface includes a first hinge at an edge of the first section, a second hinge at an edge of the second section, and a first insert configured to connect the first hinge to the second hinge; and the second hinge interface includes a third hinge at an edge of the second section, a fourth hinge at an edge of the third section, and a second insert configured to connect the third hinge to the fourth hinge.

17. The foldable keycard of claim 16, wherein one of:

the first hinge includes first pivot nubs of the first section that are sized to mate with and pivot within first pivot recesses of the first insert, the second hinge includes second pivot nubs of the second section that are sized to mate with and pivot within second pivot recesses of the first insert, the third hinge includes third pivot nubs of the second section that are sized to mate with and pivot within third pivot recesses of the second insert, and the fourth hinge includes fourth pivot nubs of the third section that are sized to mate with and pivot within fourth pivot recesses of the second insert; or the first hinge includes first pivot nubs of the first insert that are sized to mate with and pivot within first pivot recesses of the first section, the second hinge includes second pivot nubs of the first insert that are sized to mate with and pivot within second pivot recesses of the second section, the third hinge includes third pivot nubs of the second insert that are sized to mate with and pivot within third pivot recesses of the second section, and the fourth hinge includes fourth pivot nubs of the second insert that are sized to mate with and pivot within fourth pivot recesses of the third section.

18. The foldable keycard of claim 16, wherein:

the first hinge includes a first pin extending along an edge of the first section, the second hinge includes a second pin extending along an edge of the second section, and the first insert includes a first channel to snap onto the first pin to allow rotation of the first insert about the first pin and a second channel to snap onto the second pin to allow rotation of the first insert about the second pin; and the third hinge includes a third pin extending along an edge of the second section, the fourth hinge includes a fourth pin extending along an edge of the third section, and the second insert includes a third channel to snap onto the third pin to allow rotation of the second insert about the third pin and a fourth channel to snap onto the fourth pin to allow rotation of the second insert about the fourth pin.

* * * * *